US008922314B2

(12) United States Patent
Kobayashi et al.

(10) Patent No.: US 8,922,314 B2
(45) Date of Patent: Dec. 30, 2014

(54) IGNITION COIL FOR INTERNAL COMBUSTION ENGINE

(75) Inventors: Takanobu Kobayashi, Tokai (JP); Yoichi Anzo, Hitachinaka (JP); Makio Takahashi, Hitachinaka (JP)

(73) Assignee: Hitachi Automotive Systems, Ltd., Hitachinaka-shi (JP)

( * ) Notice: Subject to any disclaimer, the term of this patent is extended or adjusted under 35 U.S.C. 154(b) by 0 days.

(21) Appl. No.: 13/479,351

(22) Filed: May 24, 2012

(65) Prior Publication Data

US 2012/0299679 A1 Nov. 29, 2012

(30) Foreign Application Priority Data

May 27, 2011 (JP) ..... 2011-118609

(51) Int. Cl.

| | |
|---|---|
| ***H01F 27/02*** | (2006.01) |
| ***H01F 21/00*** | (2006.01) |
| ***H01F 27/30*** | (2006.01) |
| ***H01F 27/24*** | (2006.01) |
| ***H01F 38/12*** | (2006.01) |

(52) U.S. Cl.

CPC ..... *H01F 38/12* (2013.01)
USPC ..... 336/90; 336/198; 336/110; 336/212

(58) Field of Classification Search

USPC ..... 336/196, 90, 212, 110, 182, 198, 208; 123/635, 634, 169 CB, 169 P, 154
See application file for complete search history.

(56) References Cited

U.S. PATENT DOCUMENTS

| | | | | |
|---|---|---|---|---|
| 4,990,881 | A * | 2/1991 | Ooyabu | 336/110 |
| 5,225,801 | A * | 7/1993 | Ida et al. | 336/96 |
| 5,685,065 | A * | 11/1997 | Suzuki et al. | 29/606 |
| 6,255,930 | B1 * | 7/2001 | Kanazawa et al. | 336/96 |
| 7,701,318 | B2 * | 4/2010 | Ayusawa | 336/192 |
| 8,289,117 | B2 * | 10/2012 | Dal Re et al. | 336/110 |
| 2006/0226945 | A1 * | 10/2006 | Maekawa et al. | 336/90 |

FOREIGN PATENT DOCUMENTS

| | | | |
|---|---|---|---|
| JP | 57-47013 | U | 3/1982 |
| JP | 02-056910 | A * | 2/1990 |
| JP | 8-17657 | A | 1/1996 |
| JP | 8-45755 | A | 2/1996 |
| JP | 8-111328 | A | 4/1996 |
| JP | 2006-278379 | A | 10/2006 |
| JP | 2007-194364 | A | 8/2007 |
| JP | 2011-66098 | A | 3/2011 |

OTHER PUBLICATIONS

Japanese Office Action dated Jul. 17, 2013 (Two (2) pages).

* cited by examiner

*Primary Examiner* — Mangtin Lian
(74) *Attorney, Agent, or Firm* — Crowell & Moring LLP

(57) ABSTRACT

An auxiliary core portion and a main core portion, including a magnet if the magnet is attached, are covered by a resin film or an elastomer film and fixed as a single assembly. In this state, a coil is attached to the assembly and a side core portion is assembled to the assembly. The auxiliary core portion and the main core portion, including the magnet if it is attached, can be supplied, as the single assembly, to an automated assembly line for ignition coils. It is not necessary to position such components on the assembly line. Thus, the workability of the automated assembly can be enhanced.

21 Claims, 14 Drawing Sheets

IGNITION COIL FOR INTERNAL COMBUSTION ENGINE

BACKGROUND OF THE INVENTION

1. Field of the Invention

The present invention relates to an ignition coil for an internal combustion engine adapted to supply high voltage to an ignition plug of the engine for generating spark discharge. In particular, the invention relates to an ignition coil, for an internal combustion engine, of a type having a main core portion (also called a main yoke portion) to which a coil is attached, and an auxiliary core portion (also called an auxiliary yoke portion) or a side core portion (also called a side yoke portion), the auxiliary core portion or the side core portion being combined with the main core portion to form a closed magnetic path.

2. Description of the Related Art

The ignition coil for an internal combustion engine as described above is configured as below. A coil is attached to a main core portion (some are provided with an auxiliary core portion), and a side core portion is assembled to the main core portion (an auxiliary core portion and the side core portion are assembled to the main core portion not provided with the auxiliary core portion). The main core portion and the side core portion are set up inside a casing. The coil is connected at its winding-start-end to a terminal of an external-connection connector attached to the casing. In addition, the coil is connected at its winding-terminal-end to a terminal of the plug. Thereafter, an insulating resin is poured into the casing for resin molding.

However, the divided core portions (or including a permanent magnet if the permanent magnet is attached) likely deviate from each other due to external force, molding pressure resulting from the flow of molding resin, or molding strain during hardening, until the resin molding will be finished. Thus, there is a problem in that variations in the performance of ignition coils are increased.

To solve such a problem, an ignition coil disclosed in e.g. JP-2007-194364-A is such that a core holder is installed to hold the positional relationship among three members until the whole will be molded with resin.

JP-8-17657-A discloses an ignition coil as below. A main core portion and an auxiliary core portion are formed integrally with each other. A coil is attached to the main core portion. Thereafter, a side core portion and the auxiliary core portion are engaged and united with each other by press fitting. In addition, JP-8-17657-A describes the fact that the circumferences of core portions are covered by an elastic material to prevent the occurrence of cracking during the molding of mold resin.

SUMMARY OF THE INVENTION

Since the core holder is provided in JP-2007-194364-A, it has a problem in that assembly man-hours are increased and the cost is increased.

In the configuration of JP-8-17657-A, the core portions are held by the press-fitting engaging portion; therefore, the possibility of the positional deviation is low until the resin-molding. However, the coil portion attached to the main core portion is floating before the resin molding using an insulating resin and during the resin molding. Therefore, there is a possibility that the core portions and the coil may deviate due to the action of gravity force, or external force such as the flow-pressure occurring during the pouring of molding resin or molding-strain during the hardening of the resin. Thus, variations in the performance of ignition coils are increased and because of the positional deviation of the coil, excessive force is exerted on a connecting portion between the winding of the coil and the terminal portion of the case to disconnect the winding or the connecting portion.

It is an object of the present invention to provide an ignition coil in which a coil is hard to deviate until the finish of resin molding with a simple configuration. If a coil bobbin is simply directly sandwiched between core portions made of stacked steel plates, the coil bobbin may possibly be damaged. Thus, it is another object of the present invention to provide an ignition coil for an internal combustion engine that aims to prevent excessive force from being exerted on a coil bobbin when a coil attached to a main core portion is held between an auxiliary core portion and a side core portion and that is consequently suitable for automated assembly.

To achieve the above object of the present invention, a covering layer made of an elastic body is formed at least on an inner circumferential surface of a main core portion or an auxiliary core portion facing an end face of a coil bobbin, when a coil being attached to the main core portion, and being sandwiched between and held by the auxiliary core portion and a side core portion.

Preferably, the covering layer is formed on the full circumferences of the main core portion and the auxiliary core portion except a fitting-engaging portion of the auxiliary core portion with the side core portion.

The covering layer may be formed also on an inner circumferential surface, of the side core portion, facing the coil bobbin.

The inner and outer full circumferences of the iron core portion, except the engaging portion of the core portions, may be covered by the elastic body.

A magnet member is sandwiched between the auxiliary core portion and the main core portion.

The magnet member may be a magnetized or non-magnetized magnet member.

The auxiliary core portion and the main core portion are formed as a continuous integral one by punching out a steel plate and stacking the steel plates.

A fitting-engaging portion of the auxiliary core portion with the side core portion may be formed between an end portion outer circumferential surface of the auxiliary core portion and an end portion inner circumferential surface of the side core portion or between the end portion inner circumferential surface of the auxiliary core portion and an end portion outer circumferential surface of the side core portion.

According to the present invention, the coil bobbin is put between and held by the auxiliary core portion and the side core portion. The clearance between the core portion and the end portion of the coil bobbin can be reduced by the elastic covering layer installed between the core portion and the end portion of the coil bobbin. Therefore, the positional deviation of the coil bobbin is small. In addition, the covering layer prevents the coil bobbin and the core portion from being brought into direct pressure contact with each other. Thus, the coil bobbin is unlikely to be damaged.

Incidentally, if the core portion is divided into a plurality of portions, the auxiliary core portion and the main core portion (three members if the magnet member is sandwiched therebetween) are covered by the elastic covering layer. Consequently, they can be handled as one component. Thus, because of satisfactory assembly performance, the ignition coil for an internal combustion engine suitable for automated assembly can be provided.

DESCRIPTION OF THE PREFERRED EMBODIMENTS

Preferred embodiments of the present invention will hereinafter be described with reference to the drawings.

First Embodiment

Figure 1:
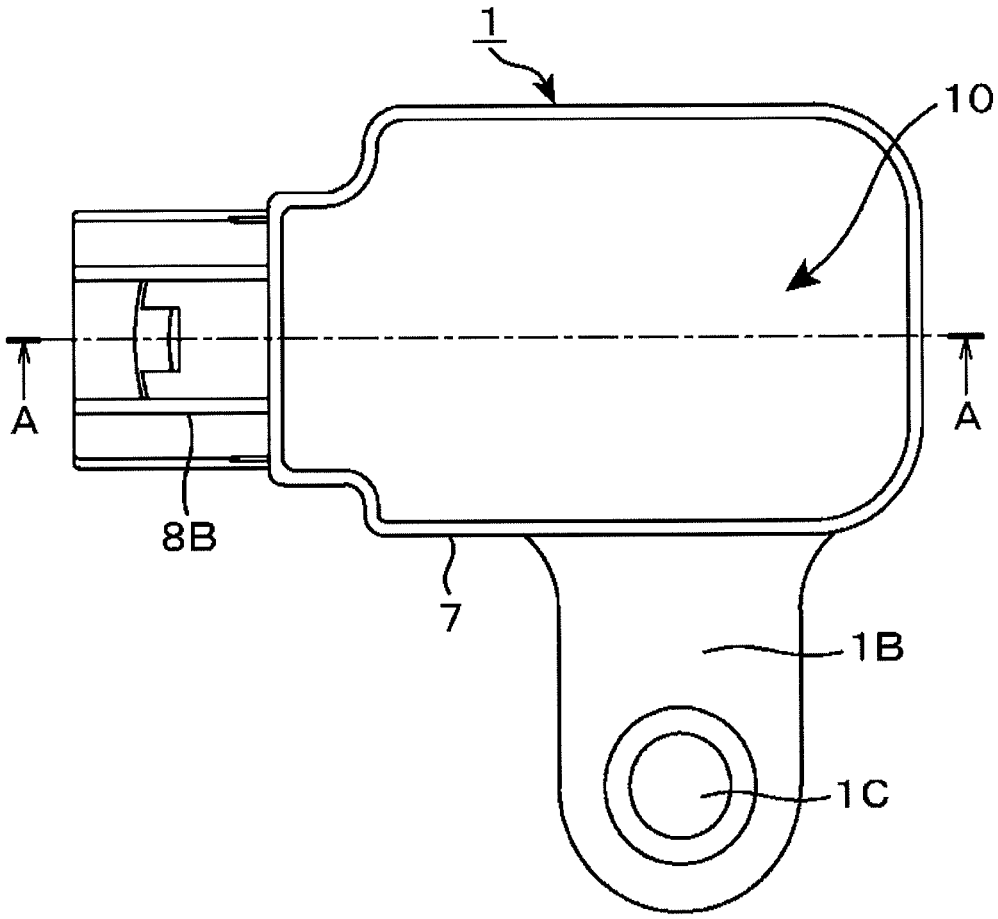
FIG. 1 is a top view of an ignition coil for an internal combustion engine according to a first embodiment of the present invention.
Figure 2:
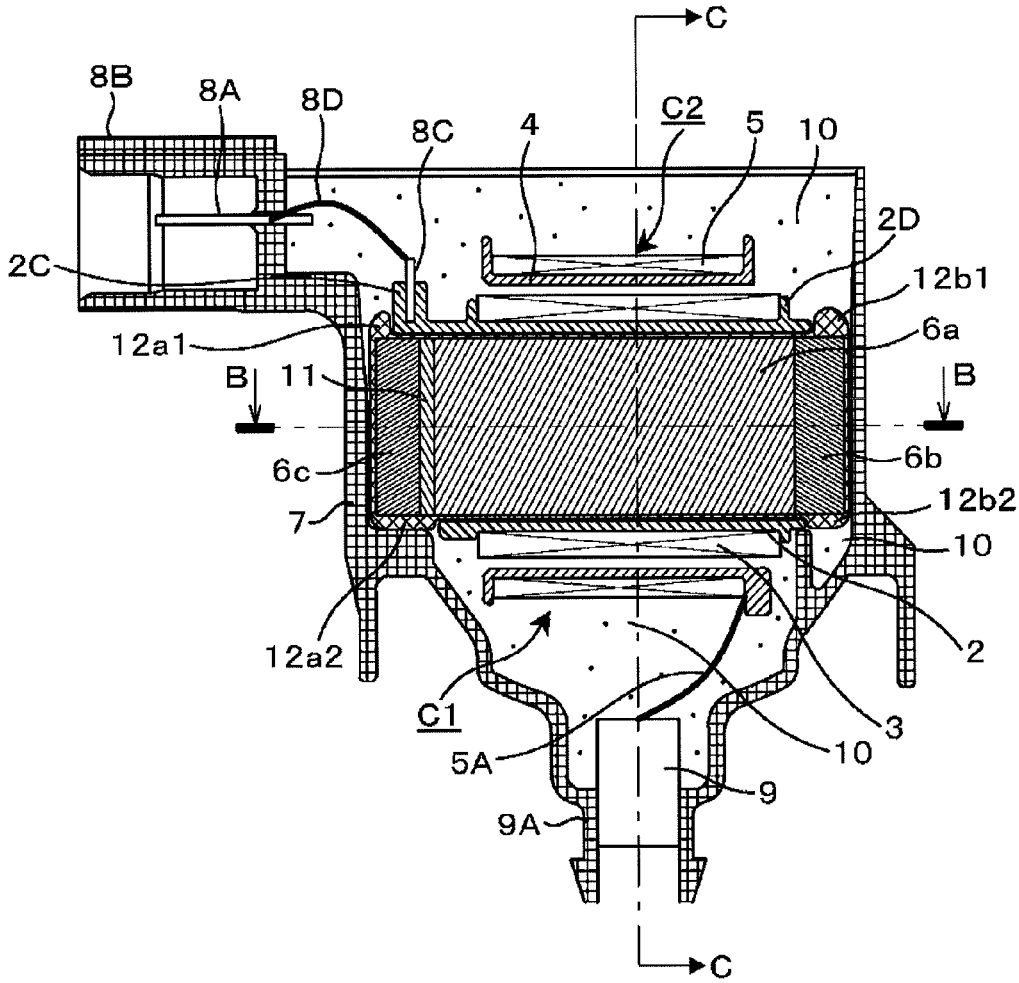
FIG. 2 is a cross-sectional view of the ignition coil taken along line A-A in FIG. 1.
Figure 3:
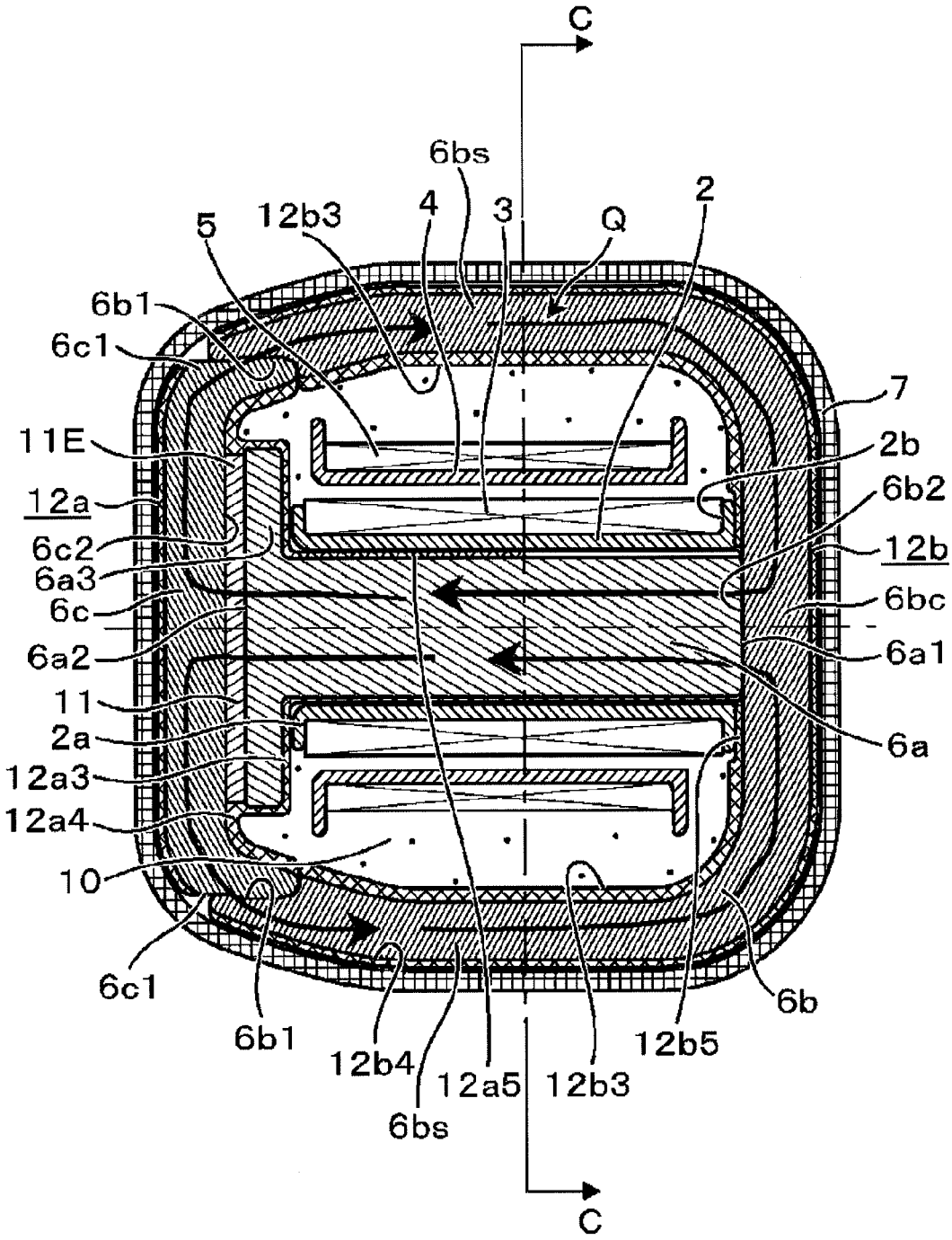
FIG. 3 is a cross-sectional view of the ignition coil taken along line B-B in FIG. 2.
Figure 4:
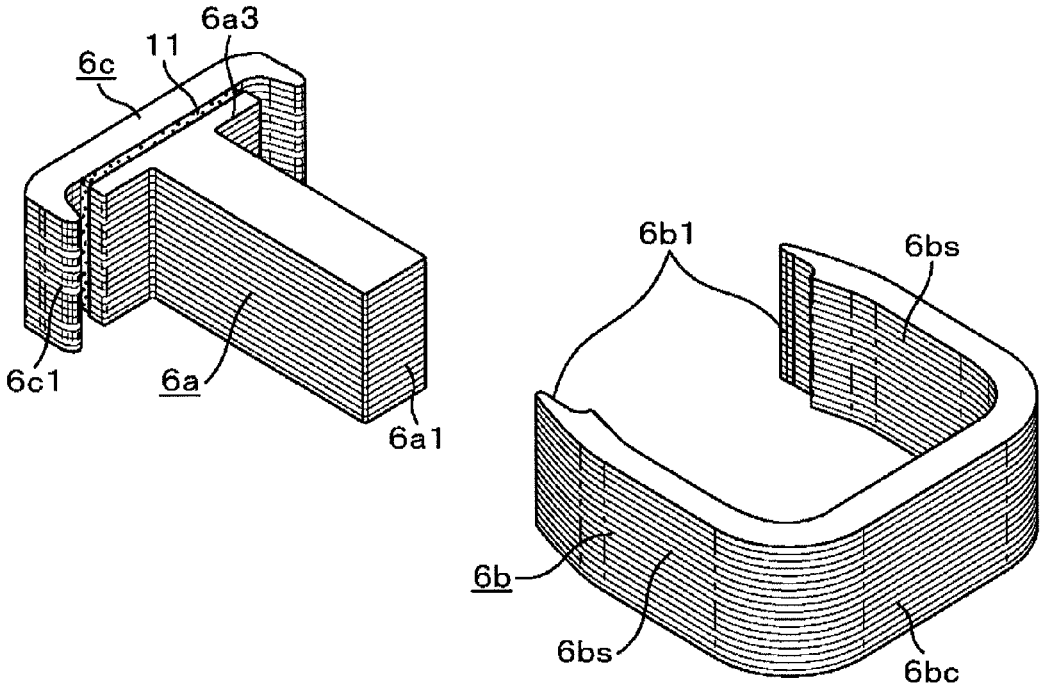
FIG. 4 is a perspective view showing the overview-shape of an iron core assembly according to the first embodiment.
Figure 5:
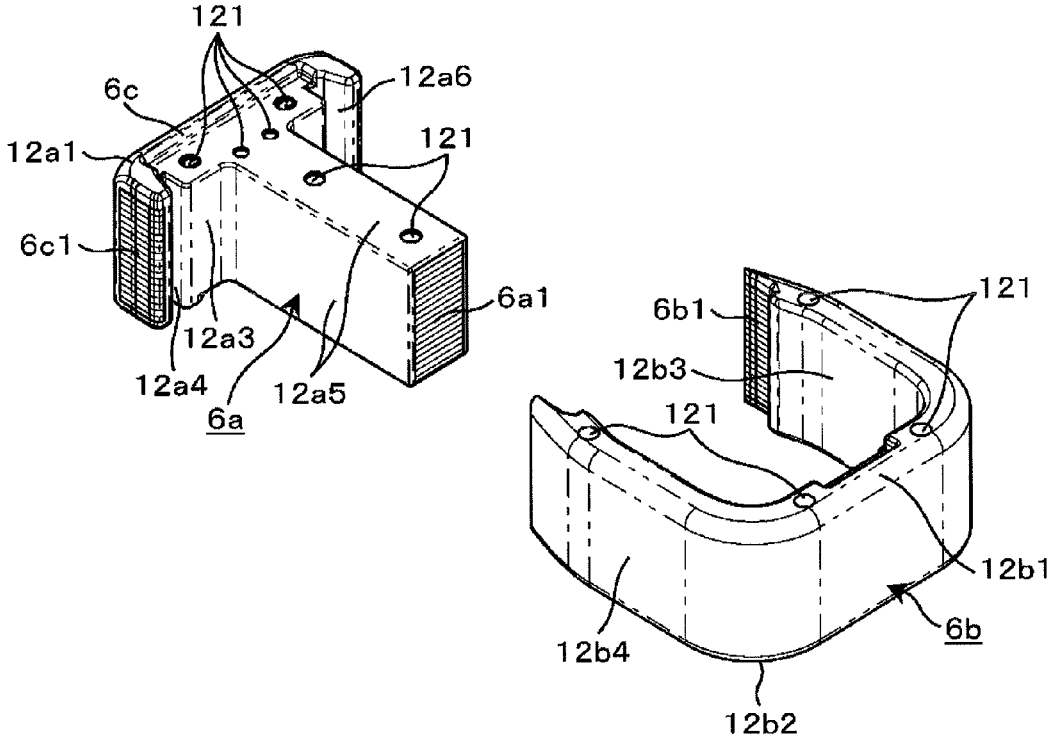
FIG. 5 is a perspective view of a core mold according to the first embodiment.
Figure 10:
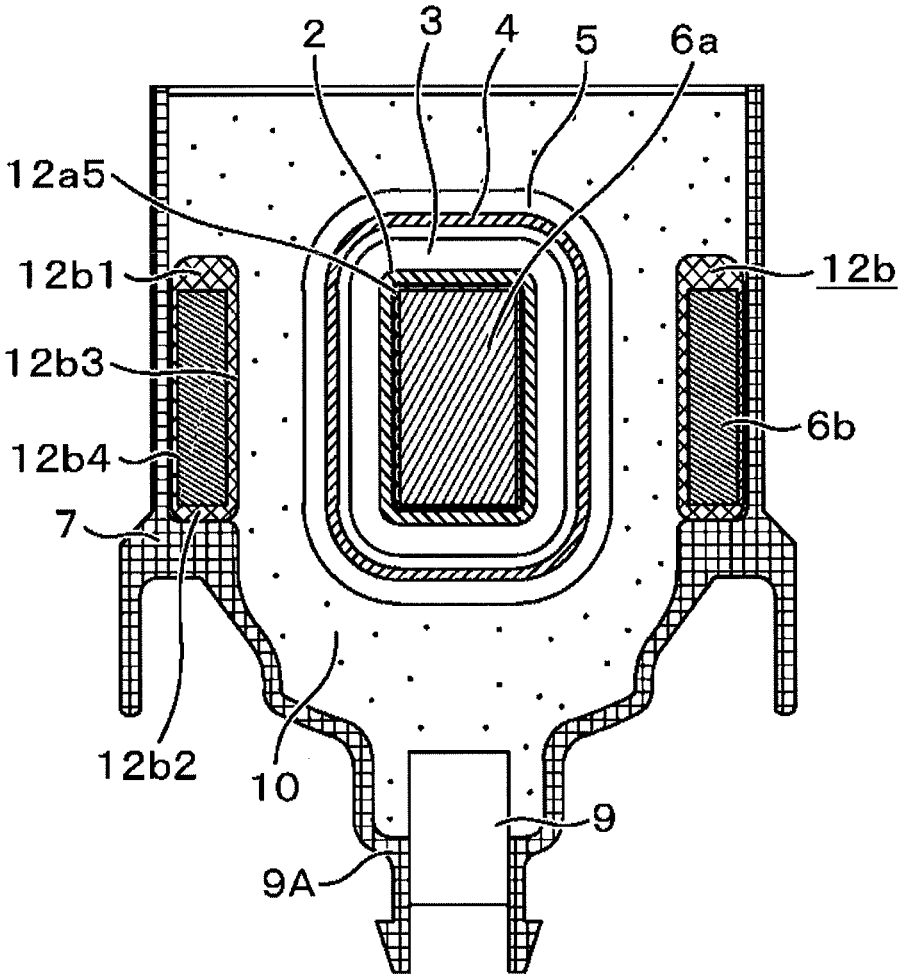
FIG. 10 is a cross-sectional view of the ignition coil taken along line C-C in FIGS. 2 and 3.
Figure 11:
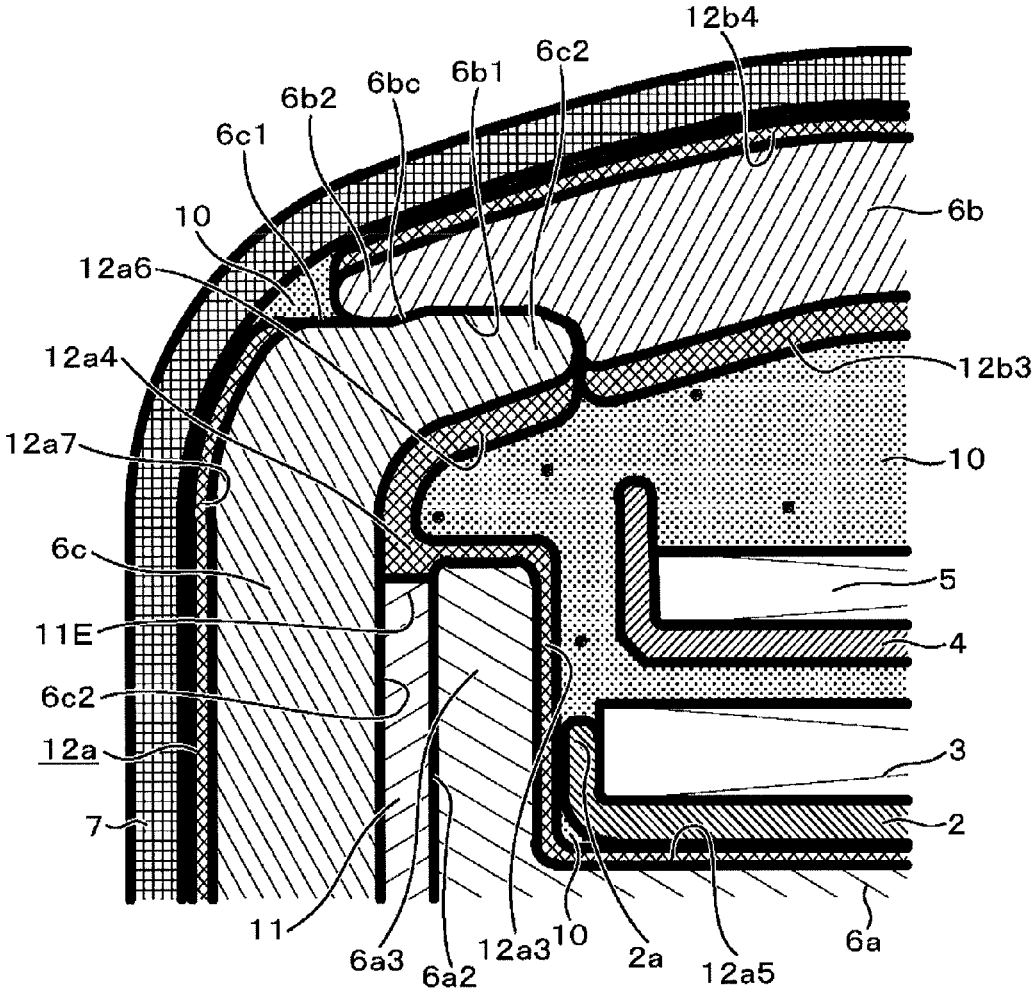
FIG. 11 is an enlarged view of an upper-left portion of FIG. 3.
Figure 12:
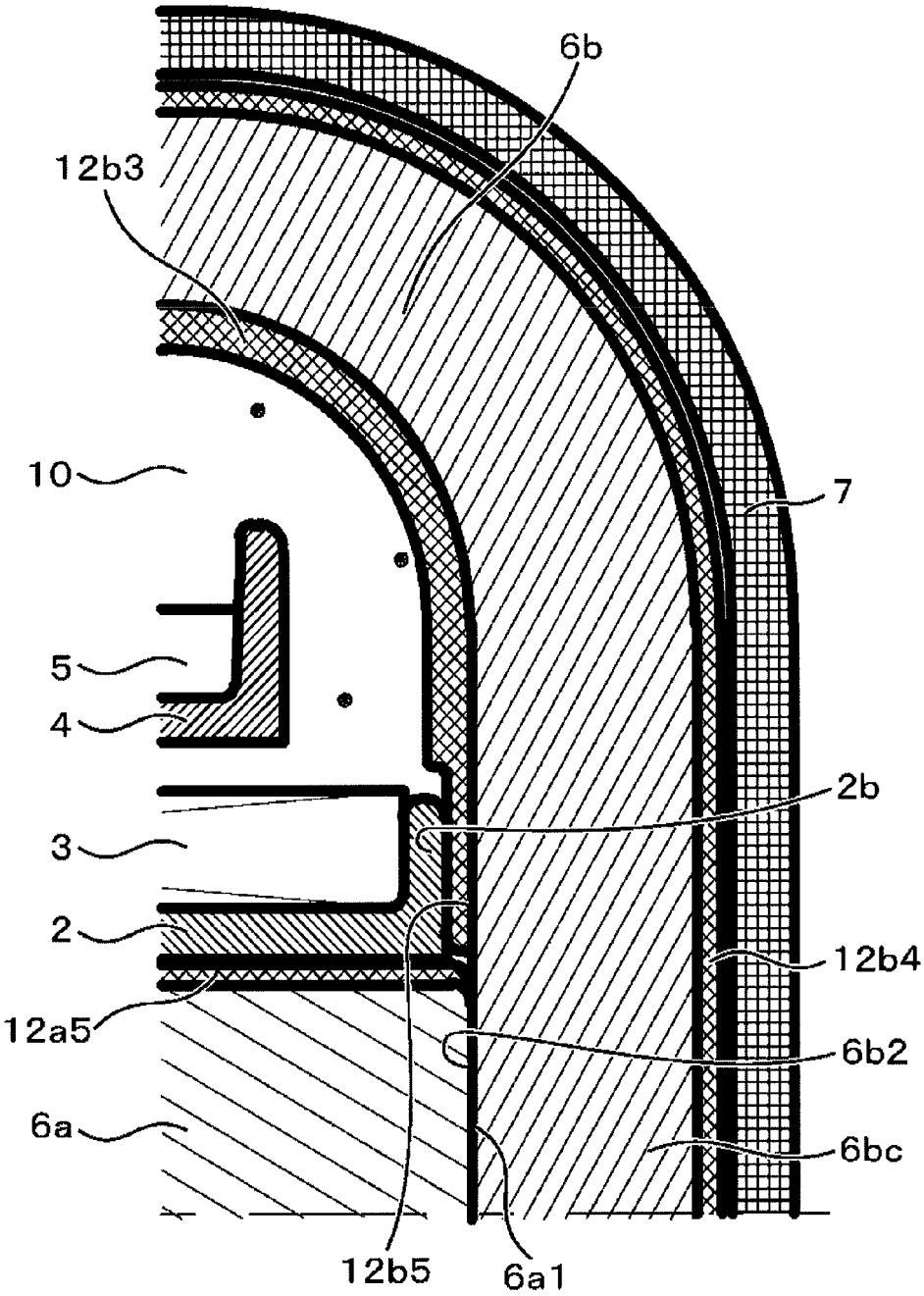
FIG. 12 is an enlarged view of an upper-right portion of FIG. 3.

An ignition coil for an internal combustion engine according to a first embodiment of the present invention is shown in FIGS. 1 to 5 and 10 to 12. FIG. 1 is a top view of an ignition coil for an internal combustion engine according to the present embodiment. FIG. 2 is a cross-sectional view of the ignition coil taken along line A-A in FIG. 1. FIG. 3 is a cross-sectional view of the ignition coil taken along line B-B in FIG. 2. FIG. 4 is a perspective view showing an arrangement shape of iron cores. FIG. 5 is a perspective view showing the iron cores covered by elastic covers. FIG. 10 is a cross-sectional view of the ignition coil taken along line C-C in FIGS. 2 and 3. FIG. 11 is an enlarged view of an upper-left portion of FIG. 3. FIG. 12 is an enlarged view of an upper-right portion of FIG. 3.

Referring to FIG. 1, an ignition coil 1 has a coil case 7 made of a resinous material.

The coil case 7 is molded integrally with a connector portion 8B and an attachment flange 1B. The connector portion 8B is used for connection with an external connector. The attachment flange 1B is used to attach the ignition coil 1 on a wall surface of an engine. The attachment flange 1B is formed with a hole 10 adapted to receive an attachment screw inserted thereinto. A front surface of an insulating resin 10 for insulating the inside of the coil case is seen on the upper surface of the coil case 7.

Referring to FIGS. 2 and 10, the ignition coil 1 of the present embodiment is the so-called single ended ignition type ignition coil for an internal combustion engine. In the single ended ignition type, a plug hole insertion portion 9A (described later) formed integrally with the coil case 7 is inserted into a plug hole formed in each cylinder of the internal combustion engine. In addition, an output end of a secondary coil is directly connected to an ignition plug (not shown).

The ignition coil 1 according to the first embodiment has an iron core assembly 6 composed of a main core portion 6*a*, a side core portion 6*b* and an auxiliary core portion 6*c*. The main core portion 6*a*, the side core portion 6*b* and the auxiliary core portion 6*c* constitute a magnetic path indicated by an arrow Q in FIG. 3.

In the iron core assembly 6, the main core portion 6*a*, the side core portion 6*b* and the auxiliary core portion 6*c* are each formed as a core portion by punching a silicon steel plate with a thickness of 0.2 to 0.7 mm into a respective shape, stacking a plurality of the silicon steel plates and press-forming the stacked silicon steel plates.

As shown in FIGS. 2 and 10, the main core portion 6*a* is inserted into the inside of a primary coil bobbin 2 of rectangular cross-section. The primary coil bobbin 2 is formed of a thermoplastic synthetic resin. An enamel wire having a diameter of approximately 0.3 to 1.0 mm is wound around the outer circumference of the primary coil bobbin 2 at several layers, several ten times per single layer, and approximately one hundred to three hundred times in total.

A secondary coil bobbin 4 of rectangular cross-section is concentrically disposed around the primary coil bobbin 2 with a clearance defined therebetween. The secondary coil bobbin 4 is formed of a thermoplastic synthetic resin similarly to the primary coil bobbin 2. A plurality of winding grooves are formed on the outer circumference of the secondary coil bobbin 4 in the longitudinal direction. An enamel wire having a diameter of approximately 0.03 to 0.1 mm is wound around the outer circumference of the secondary coil bobbin 4 at several ten layers to several hundred layers per each groove, and five thousand to thirty thousand times in total.

The primary coil bobbin 2 is inserted into the inside of the secondary coil bobbin 4. A magnet member 11 is mounted so as to be sandwiched between an auxiliary core portion side end of the main core portion 6*a* and the auxiliary core portion 6*c*. The magnet member 11 is magnetized in the direction opposite to the direction of the magnetic flux generated in the main core portion 6*a* when the primary coil 3 is energized. A primary coil portion C1, a secondary coil portion C2 and the iron core assembly 6 are housed in the coil case 7. The primary coil portion C1 is composed of the primary coil bobbin 2 and the primary coil 3 wound around the primary coil bobbin 2. The secondary coil portion C2 is composed of the secondary coil bobbin 4 and the secondary coil 5 wound around the secondary coil bobbin 4.

The coil case 7 is resin-molded integrally with a connector portion 8B. An electric connection terminal 8A is insert-molded integrally with a resinous compact of the coil case 7 in the connector portion 8B. The electric connection terminal 8A is used to electrically connect the primary coil 3 to the outside. A projecting portion 2C is formed at the auxiliary core portion 6*c* side end portion of the primary coil bobbin 2 of the primary coil 3 so as to extend to a stacking-directional upper surface of the auxiliary core portion 6*c*. An input terminal 8C is insert-molded in the projecting portion 2C. The input terminal 8C and the electric connection terminal 8A of the connector portion 8B are electrically interconnected inside the coil case 7 via a line 8D. An electric current to be supplied to the primary coil 3 is supplied thereto via the electric connection terminal 8A. Although not shown, an external connector is inserted into the connector portion 8B for connection and the electric connection terminal 8A is connected to a power terminal of the external connector.

On the other hand, a high-voltage terminal 9 is integrally insert-molded by a resin mold on a plug hole insertion portion 9A side of the coil case 7. An output end 5A of a winding of the secondary coil 5 is connected to the high-voltage terminal 9. An electric current applied to the primary coil 3 is cut by a semiconductor switching element not shown to induce high voltage in the secondary coil 5. The high voltage induced in the secondary coil 5 is supplied to an ignition plug (not shown) via the high-voltage terminal 9 resin-molded integrally with the coil case 7. Thus, the ignition plug generates spark discharge.

The output terminal 5A of the winding of the secondary coil 5 is connected to the high-voltage terminal 9 and the input terminal 8C of the winding of the primary coil is connected to the electric connection terminal 8A of the connector portion 8B. In this state, the iron core assembly 6, the primary coil portion C1 and secondary coil portion C2 are housed and set up in the coil case 7. A thermo-setting resin (specifically, an epoxy resin) as an insulating resin 10 is filled in the coil case 7. The insulating resin 10 is filled in the entire inside of the coil case 7: clearances between the windings of the primary coil 3 wound around the primary coil bobbin 2 and between the windings of the secondary coil 5 wound around the secondary coil bobbin 4; the circumferences of the primary coil portion C1, the secondary coil portion C2 and the iron core assembly 6 and the clearances therebetween; the circumference of the connecting portion between the input end 8C of the primary coil 3 and the connecting terminal 8A of the connector portion 8B; and the circumference of the connecting portion between the high-pressure terminal 9 and the output end 5A of the secondary coil 5. In this way, these components are insulated from one another and united with one another in the coil case 7.

As shown in FIGS. 3 and 4, the iron core assembly 6 of the present embodiment is composed of the three divided portions: the main core portion 6*a*, the side core portion 6*b*, and the auxiliary core portion 6*c*. The magnet member 11 is shaped like a thin plate and assembled between the main core portion 6*a* and the auxiliary core portion 6*c*. Further, as shown in FIG. 5, the iron core assembly 6 and the magnet member 11 are covered on their outer surfaces by a mold material except joint surfaces 6*a*1, 6*b*2 between the main core portion 6*a* and the side core portion 6*b*, a joint surface 6*c*2 between the magnet member 11 and the auxiliary core portion 6*c*, joint surfaces 6*c*1, 6*b*1 between the side core portion 6*b* and the auxiliary core portion 6*c*, and a joint surface 6*a*2 between the magnet member 11 and the main core portion 6*a*. These covering layers are hereinafter called the core molds 12*a*, 12*b*. The core molds 12*a*, 12*b* are made of a thermoplastic resin, elastomer or rubber.

In the present embodiment, the non-magnetized magnet member 11 is sandwiched between flange portions 6*a*3 formed at end portions of the main core portion 6*a* and the auxiliary core portion 6*c* and is set up in a mold. A mold material (a thermoplastic resin, elastomer or rubber such as silicon rubber) is poured into the mold to cover the circumferential surfaces of the main core portion 6*a*, the magnet member 11 and the auxiliary core portion 6*c*. In this way, these three components are configured as a single molded assembly component.

In this case, the main core portion 6*a*, the magnet member 11 and the auxiliary core portion 6*c* are tightly pressed so as to prevent the mold material from pouring in the joint surface between the main core portion and the magnet member 11 and the joint surface between the magnet member 11 and the auxiliary core portion 6*c*. The joint surface (both sides) 6*c*1 of the auxiliary core portion 6*c* with the side core portion 6*b* and the contact surface 6*a*1 of the main core portion 6*a* with the side core portion 6*b* are brought into tight contact with the front surface of the mold so as to prevent the molding material from extending over the joint surface and the contact surface mentioned above. Then, the main core portion 6*a* and the auxiliary core portion 6*c* are molded. A tape capable of being removed later may be applied to the joint surface (both sides) 6*c*1 of the auxiliary core portion 6*c* with the side core portion 6*b* and to the contact surface 6*a*1 of the main core portion 6*a* with the side core portion 6*b*. Then, the main core portion 6*a* and the auxiliary core portion 6*c* are molded. After the molding, the tape may be removed to expose the joint surface and the contact surface.

As shown in FIG. 5, a plurality of recessed portions 121 are formed in the front surface of the core mold 12 as an elastic covering portion. These recess portions 121 are formed after temporary pins which held the main core portion 6*a* and the magnet member 11 in the mold have been removed. The recessed portions 121 are used as holes to confirm whether or not the core mold 12 contains a magnet therein and of which type the core mold 12 is.

With this configuration, the respective assembly positions of the auxiliary core portion 6*c*, the magnet member 11 and the main core portion 6*a* are determined in the mold. Therefore, their positions will not be misaligned after the molding of such components. The circumferential surface of an outside portion 11E of the magnet member 11 sandwiched between the main core portion 6*a* and the auxiliary core portion 6*c* is covered and protected by the film of a core mold 12*a*4. Therefore, an edge portion of the magnet member 11 is hard to be damaged by shocks during the assembly. Even if the edge portion of the magnet member 11 is damaged, then broken pieces of the permanent magnet will not fly apart. Therefore, the broken pieces of the magnet member will not drop in a production line.

As shown in FIGS. 2 and 5, the core mold 12*a* has a covering layer 12*a*1 covering an upper end portion (the upper end portion in FIG. 2), in a stacking direction, of the auxiliary core portion 6*c* and a covering layer 12*a*2 covering a lower end portion (the lower end portion in FIG. 2), in the stacking direction, of the auxiliary core portion 6*c*. The covering layers 12*a*1, 12*a*2 are formed thicker than the other portions of the core mold 12*a*. The covering layer 12*a*1 formed thick faces the projecting portion 2C formed at an end portion of the primary coil bobbin 2 of the primary coil 3. The covering layer 12*a*2 covering the lower end surface (the lower end portion in FIG. 2) of the auxiliary core portion 6*c* faces an end portion excluding the projecting portion 2C formed at the end portion of the primary coil bobbin 2 of the primary coil 3.

Further, the core mold 12*a* has a covering layer 12*a*5 covering an longitudinal outer surface of the main core portion 6*a*, a covering layer 12*a*3 covering an outer surface portion of the flange portion 6*a*3, and a covering layer 12*a*4 covering the circumference of the outer side surface 11E of the magnet member 11. The primary coil bobbin 2 is inserted through above the covering layer of the core mold 12*a*5 of the main core portion 6*a*. Therefore, the primary coil bobbin 2 is not rubbed by the edge of the main core portion 6*a* so that it will not chip off.

With this configuration, although the magnet member 11 is assembled in the non-magnetized state, the main core portion 6*a*, the magnet member 11 and the auxiliary core portion 6*c* are positioned by being set up in the mold. Therefore, an assembly error for each product is small. After the molding, the main core portion 6*a*, the magnet member 11 and the auxiliary core portion 6*c* can be handled as one component; therefore, assembly performance is enhanced. This configuration is particularly advantageous to automated assembly. Incidentally, if the core mold 12*a* is applied in the non-magnetized state, then magnetization is performed in a subsequent process.

As shown in FIGS. 2, 3 and 12, similarly also the side core portion 6*b* is covered by the core mold 12 in the present embodiment. In this case, the contact surface 6*b*2 of the side core portion 6*b* with the main core portion 6*a* and the joint surface portion (both sides) of the side core portion 6*b* with the auxiliary core portion 6*c* are brought to tight contact with the mold to prevent the mold-covering member from pouring thereinto. Otherwise, a tape is applied to the contact surface and the joint surface portion and is removed therefrom to expose the contact surface and the joint surface portion.

In this way, the joint surfaces 6*a*1, 6*b*2 between the main core portion 6*a* and the side core portion 6*b* and the joint surface portions 6*b*1, 6*c*1 between the side core portion 6*b* (both sides) and the side core portion 6*c* are in magnetically tight contact with each other to form an appropriate magnetic path.

As shown in FIGS. 3, 11 and 12, the side core portion 6*b* has a linking core portion 6*bc* which is disposed parallel to the auxiliary core portion 6*c* with the main core portion 6*a* put therebetween. The side core portion 6*b* has a pair of parallel core portions 6*bs* at both end portions of the linking core portion 6*bc*. The parallel core portions 6*bs* extend to the auxiliary core portion 6*c* in parallel to the main core portion 6*a*. The parallel core portions 6*bs* have leading end portions on both sides mating-engaged with corresponding end portions, on both sides, of the auxiliary core portion 6*c* at corresponding engaging portions 6*bc*. Specifically, projecting portions 6*b*2 formed at the leading end portions, on both sides, of the parallel core portions 6*bs* are brought into contact with the outside of corresponding end projecting portions 6*c*2 of the auxiliary core portion 6*c*. In addition, the auxiliary core portion 6*c* and the side core portion 6*b* are pressed to each other along the main core portion 6*a*. The projecting portion 6*b*2 is mating-engaged, in a pressure-contact state, with the projecting portion 6*c*2 of the auxiliary core portion 6*c* along the engaging surface 6*c*1 of the auxiliary core portion 6*c*. Similarly, the projecting portion 6*c*2 of the auxiliary core portion 6*c* is mating-engaged, in the pressure-contact state, with the projecting portion 6*b*2 along the inner engaging surface 6*b*1 of the end portion of the parallel core portion 6*bs* of the side core portion 6*b*. The projecting portions 6*b*2, 6*c*2 are fitted to each other in a state where the projecting portion 6*b*2 is expanded outwardly until the middle of the mating. In addition, the projecting portions 6*b*2, 6*c*2 are mating-engaged with each other at the engaging surface 6*bc* in a state where the projecting portion 6*b*2 is contracted inwardly when the projecting portion 6*b*2 overrides the engaging surface 6*bc*. The inner engaging surface 6*b*1 of the end portion of the parallel core portion 6*bs* of the side core portion 6*b* and the outer engaging surface 6*c*1 of the auxiliary core portion 6*c* are engaged with each other in an elastic state; therefore, they are brought into tight contact with each other with the engaging surface 6*bc* therebetween. In this case, the end portion 6*a*1 of the main core portion 6*a* is pressed against an exposed surface 6*b*2 of the side core portion 6*b* by elastic force occurring between the inner engaging surface 6*b*1 of the leading end portion of the parallel core portion 6*bs* of the side core portion 6*b* and the outer engaging surface 6*c*1 of the auxiliary core portion 6*c*. In this way, both the main core portion 6*a* and the side core portion 6*b* are brought into tight contact with each other at this portion. Thus, an appropriate magnetic path having small magnetic resistance is formed.

The configuration described above is useful to firmly hold the mutual positional relationship among the iron core assembly 6 and the coil portions C1, C2 until they are set up in the coil case 7 and the molding is finished.

The core mold 12*b* covering the circumference of the side core portion 6*b* has a covering layer 12*b*1 covering an upper end portion (the upper end portion in FIG. 2), in a stacking direction, of the side core portion 6*b* and a covering layer 12*b*2 covering a lower end portion (the lower end portion in FIG. 2), in the stacking direction, of the auxiliary core portion 6*b*. The covering layers 12*b*1, 12*b*2 are formed thicker than the other portions of the core mold 12*b*. The covering layers 12*b*1, 12*b*2 formed thick face a cylindrical end portion 2D formed at a side core portion 6*b* side end portion of the primary coil bobbin 2 of the primary coil 3.

As shown in FIG. 3, the primary coil bobbin 2 of the primary coil 3 has flange portions 2*a*, 2*b* at both end portions except the projecting portion 2C and the cylindrical end portion 2D. The flange portion 2*a* has an end portion facing the covering layer 12*a*3 covering the inside of the flange portion 6*a*3 of the main core portion 6*a*. The flange portion 2*b* has an end portion facing the covering layer 12*b*3 covering the inside of the side core portion 6*b*, particularly, facing the core mold 12*b*5 formed thin around the joint surface portion 6*b*2 between the end portion 6*a*1 of the main core portion 6*a* and the side core portion 6*b*. Clearances between both end portions of the primary coil bobbin 2 and the covering layers 12*a*1, 12*a*2, 12*a*3 and 12*b*1, 12*b*2, 12*b*5 facing both the end portions thereof are set at 0 to 0.2 mm (millimeter) in the state where the auxiliary core portion 6*c* and the side core portion 6*b* are mating-engaged with each other.

Incidentally, the primary and secondary coil portions C1, C2 are temporarily mounted by engaging means not shown so as not to be relatively displaced in the longitudinal direction. Therefore, if the side core portion 6*b* and the auxiliary core portion 6*c* are mating-engaged with each other in the state where the primary and secondary coil portions C1, C2 are attached to the main core portion 6*a*, the primary coil bobbin 2 is held between the side core portion 6*b* and the auxiliary core portion 6*c* mostly without play.

The primary and secondary coil portions C1, C2, along with the iron core assembly 6, are set up in the coil case 7 and the insulating resin 10 is poured into the coil case.

In this case, the flow of the insulating resin 10 reaches the clearance of 0 to 0.2 mm (millimeter) between both the end portions of the primary coil bobbin 2 and the core molds 12*a*1, 12*a*2, 12*a*3; 12*b*1, 12*b*2, 12*b*5 facing both the end portions of the primary bobbin 2. However, the clearance is originally small; therefore, the primary coil bobbin 2 is not relatively displaced by the flow-pressure of the insulating resin. The primary coil bobbin 2 has both end faces firmly held between the core molds 12*a*1, 12*a*2, 12*a*3 and 12*b*1, 12*b*2, 12*b*5. Therefore, the winding is not disconnected and the joint portion between the winding and the connecting terminal does not come off. The molding resin becomes hardened which flows into the clearances of 0 to 0.2 mm (millimeter) between both the end faces of the primary coil bobbin 2 and the core molds 12*a*1, 12*a*2, 12*a*3 and 12*b*1, 12*b*2, 12*b*5. Molding strain occurring due to this hardening is absorbed by the core molds 12*a*, 12*b* or elastic bodies. Thus, the molding strain will not deform the primary coil bobbin 2 and will not break the magnet member 11.

As described above, the core molds 12*a*, 12*b* of the iron core assembly 6 are each formed thicker at the upper surface portion and the lower surface portion, in the stacking direction, of the iron core assembly 6 than at the other portion corresponding to the direction perpendicular to the stacking direction of the iron core assembly 6. In addition, the core molds 12*a*, 12*b* are each formed thicker at the inner surface portion of the iron core assembly 6 than at the outer surface portion. This intends to prevent cracking of the insulating resin 10 covering the circumference of the core mold 12, as below. When the ignition coil 1 undergoes heat stress, the insulating resin 10 may be subjected to stress concentration by the corner of the iron core and cracked. Specifically, if the corner portion of the core mold 12 is rounded, the insulating resin 10 is hard to be cracked. However, the rounded portion having a larger radius is more effective. If the rounded portion is increased in radius, since the inner wall of the coil case is located in the outer circumferential direction of the iron core assembly, the core mold 12 is formed thick at the upper surface portion and lower surface portion, in the stacking direction, of the iron core assembly 6. If the core mold 12 is formed thick at a portion corresponding to the direction perpendicular to the stacking direction of the iron cores, i.e., to the coil case 7 side, the ignition coil 1 grows in size. Because of this, the core mold 12 is formed thick in the stacking direction of iron cores; therefore, the corner portion of the core mold 12 can be made to have a large radius without the enlargement of the size of the ignition coil 1. Since the core mold 12 is provided with the thick portions, the flowing performance of resin is enhanced during the molding. Specifically, as shown in FIGS. 2, 5 and 11, the thick portions 12*a*1, 12*a*2 of the core mold is formed at the upper and lower end faces, in the stacking direction, of the auxiliary core portion 6*c*. As shown in FIGS. 3, 5 and 12, the thick portions 12*b*1, 12*b*2 of the core mold 12*b* is formed at the upper and lower end faces of the side core portion 6*b*.

As shown in FIGS. 2, 5 and 11, the core mold 12*a*5, the core mold 12*a*3 and a core mold 12*a*7 are each formed to have a thickness approximately ⅓ to ½ of the core mold 12*a*6 at the inside portion of both end portions of the auxiliary core portion 6*c* of the primary coil bobbin 2. Incidentally, the core mold 12*a*5 is located at a surface portion of the main core portion 6*a* through which the primary coil bobbin 2 is passed through. The core mold 12*a*3 is formed at the surface portion of the flange portion 6*a*3 of the main core portion 6*a* facing the flange portion 2*a* located at the end portion of the primary coil bobbin 2. The core mold 12*a*7 is located at an external side surface portion of the auxiliary core portion 6*c*. Also a portion, close to the main core portion 6*a*, of the upper surface portion of the auxiliary core portion 6*c* is formed thin similarly to the core mold 12*a*5 at the surface portion of the main core portion 6*a* through which the primary coil bobbin 2 is passed.

The iron core assembly 6 has a complicated shape and many edge portions on the inner circumferential surface side thereof. This inner circumferential surface side has enlarged clearances serving as mold-material flow passages formed between the iron core assembly 6 and the mold. This makes it easy for the mold material to flow. Consequently, the covering layers of the mold material are thick at large clearances (see the core molds 12*a*4, 12*a*6, 12*b*3).

As shown in FIGS. 2 and 5, the core molds 12*a*1 and 12*a*5 of the core mold 12*a* formed on the upper surface side, in the stacking direction in FIG. 2, of the iron core assembly 6 are formed thick and thin, respectively. Therefore, the core mold 12*a* is formed in a concavo-convex shape in which the inside is concave and the outside is convex. The concavo-convex portion of the core mold 12*a* is formed to surround the circumference of the projecting portion 2C, of the primary coil bobbin 2, formed at the auxiliary core portion 6*c* side end. In addition, the concavo-convex portion of the core mold 12*a* serves to position the primary coil bobbin 2 at the time of assembling it to the outer circumference of the iron core assembly 6. On the lower end surface side of the auxiliary core portion 6*c*, the thick portion of the core mold 12*a* extends to under the magnet member. In addition, the thin portion of the core mold 12*a* extends from the joint surface between the core mold 12*a* and the magnet member 11 to the side core portion 6*b* side end portion of the main core portion 12. As described above, the core mold 12*a* is made different in thickness and shape between the upper surface and the lower surface; therefore, it is possible to prevent the core mold 12 from being assembled in an erroneous direction, i.e., to prevent the so-called erroneous assembly.

Second Embodiment

Figure 6:
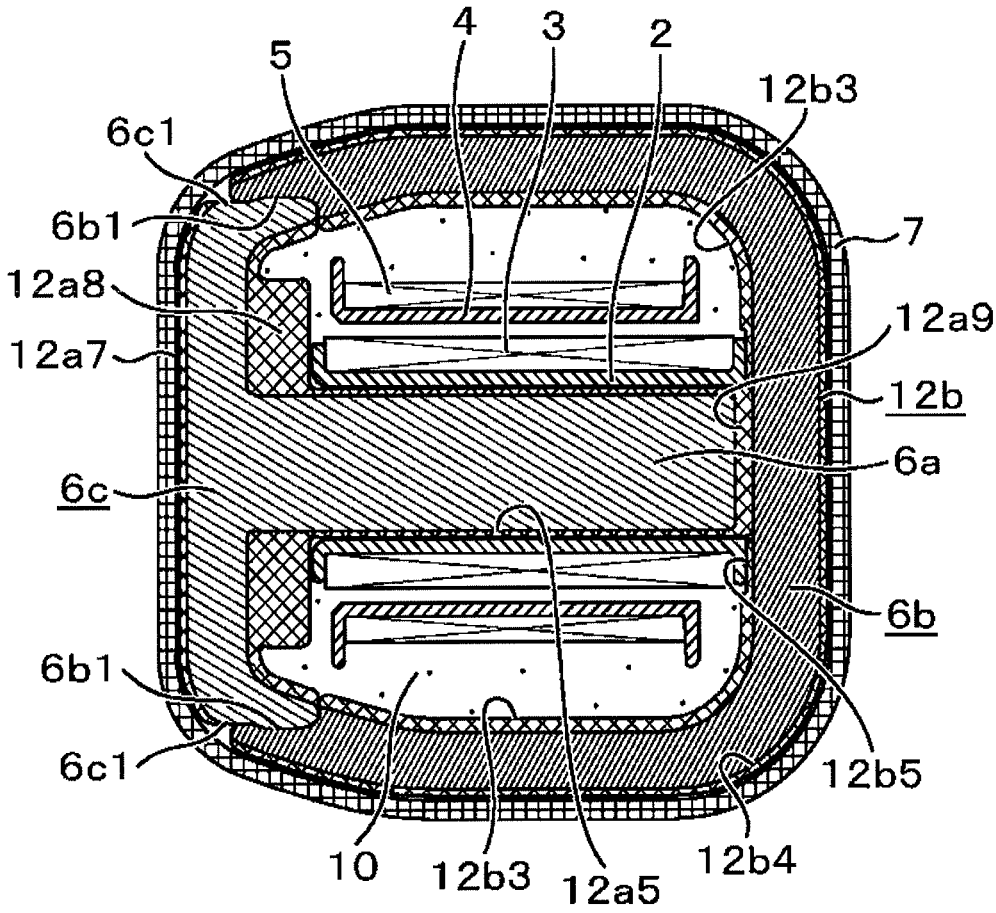
FIG. 6 is a cross-sectional view of an ignition coil according to a second embodiment.
Figure 13:
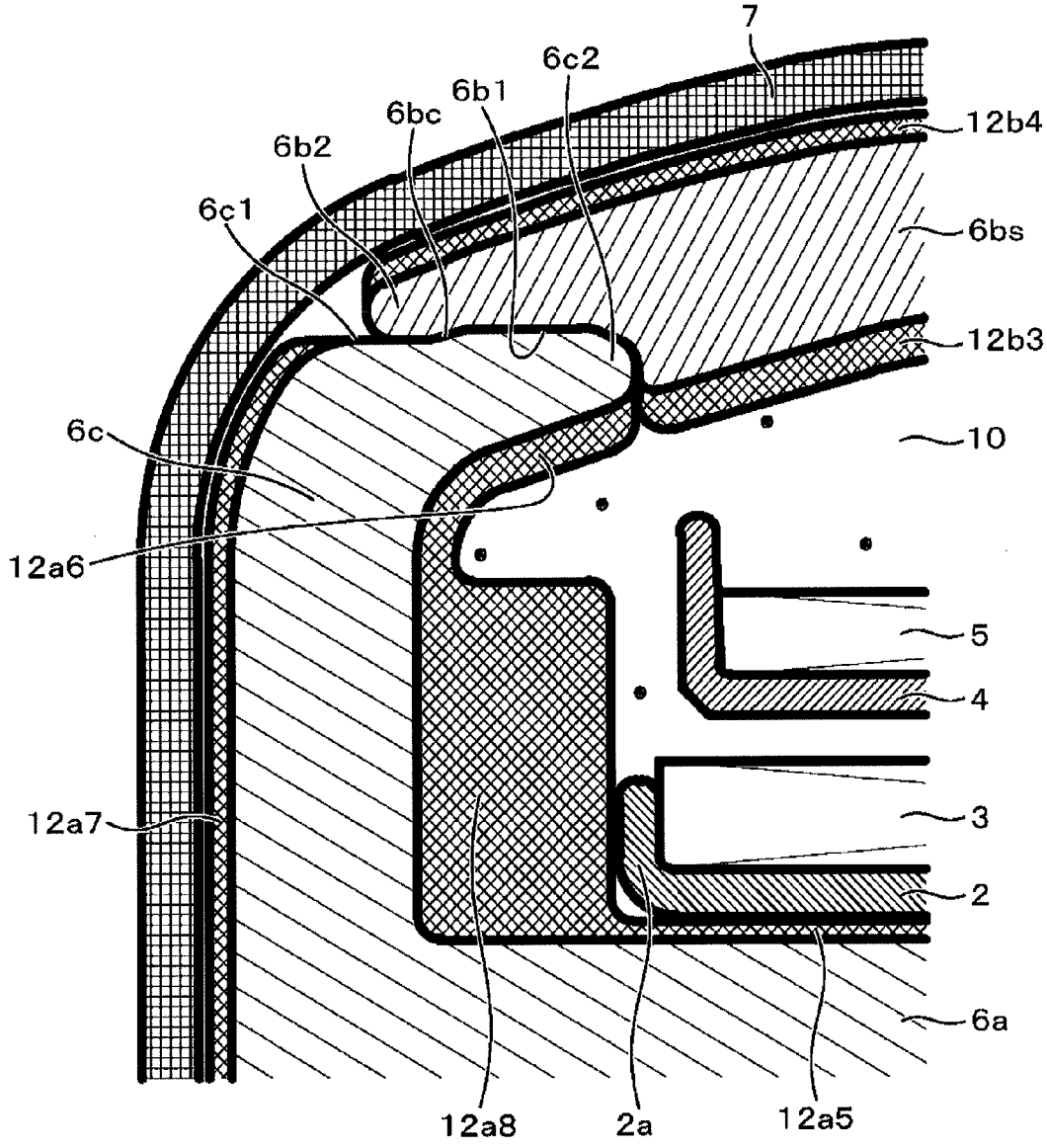
FIG. 13 is an enlarged view of an upper-left portion of FIG. 6.
Figure 14:
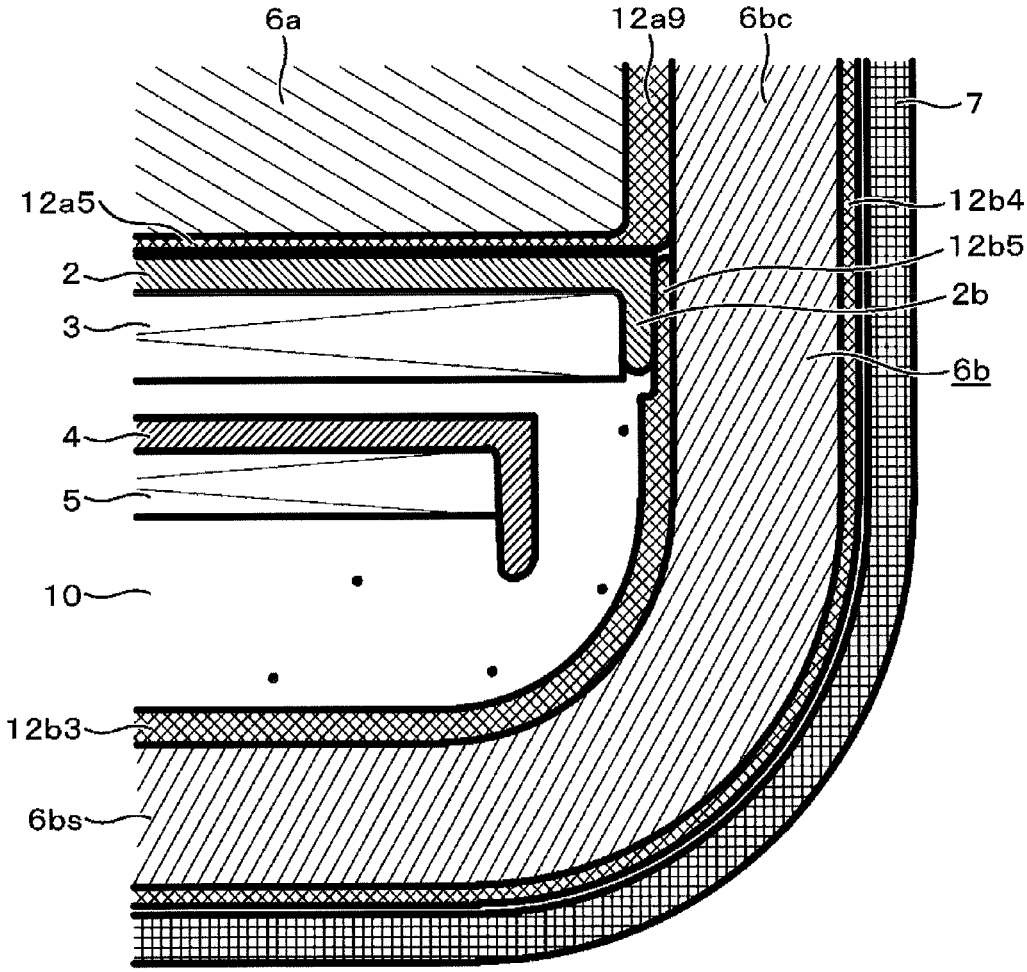
FIG. 14 is an enlarged view of a lower-right portion of FIG. 6.

A second embodiment is hereinafter described with reference to FIGS. 6, 13 and 14.

In the second embodiment, a main core portion 6*a* and an auxiliary core portion 6*c* are punched out as an integral thin steel plate and the integral thin plates are stacked one on another. Therefore, a magnet member is not installed between the main core portion 6*a* and the auxiliary core portion 6*c*.

The coil case 7 is shared by the first embodiment and the second embodiment; therefore, an iron core assembly 6 has the same external dimensions as those of the first embodiment. The second embodiment uses the same coil assembly as that of the first embodiment.

A core mold 12*a*8 between an end portion of a primary coil bobbin 2 and the auxiliary core portion 6*c* is increased in thickness by the thickness of the magnet member 11. In addition, the core mold 12*a*8 has an outer shape formed to conform to the shape of a projecting portion of the primary coil bobbin 2.

The main core portion 6*a* has a side core portion 6*b* side end portion covered by a core mold 12*a*9. Consequently, a magnetic gap corresponding to the thickness of the core mold 12*a*9 is defined between the side core portion 6*b* and the end portion of the main core portion 6*a*. Thus, magnetic saturation of a magnetic path is suppressed at this portion.

In this way, the auxiliary core portion and main core portion covered by the core molds 12*a*7, 12*a*8, 12*a*3, 12*a*9 according to the second embodiment are formed to have the same external shape as that according to the first embodiment.

Thus, the auxiliary core portion and the main core portion can be handled as one component during assembly regardless of the absence or presence of the magnet member. As described above, the auxiliary core portion and the main core portion are covered by the core molds; therefore, ignition coils can be assembled in the same production line regardless of the absence or presence of the magnet member. This leads to the reduced cost of installation.

Incidentally, to prevent erroneous assembly in the same production line by distinguishing between the absence and presence of the magnet assembly, it is preferable to make it possible to visually confirm the absence and presence of the magnet member by forming a concavo-convex portion on the core mold on the iron-core-stacking-directional surfaces as shown in FIG. 5.

Third Embodiment

Figure 7:
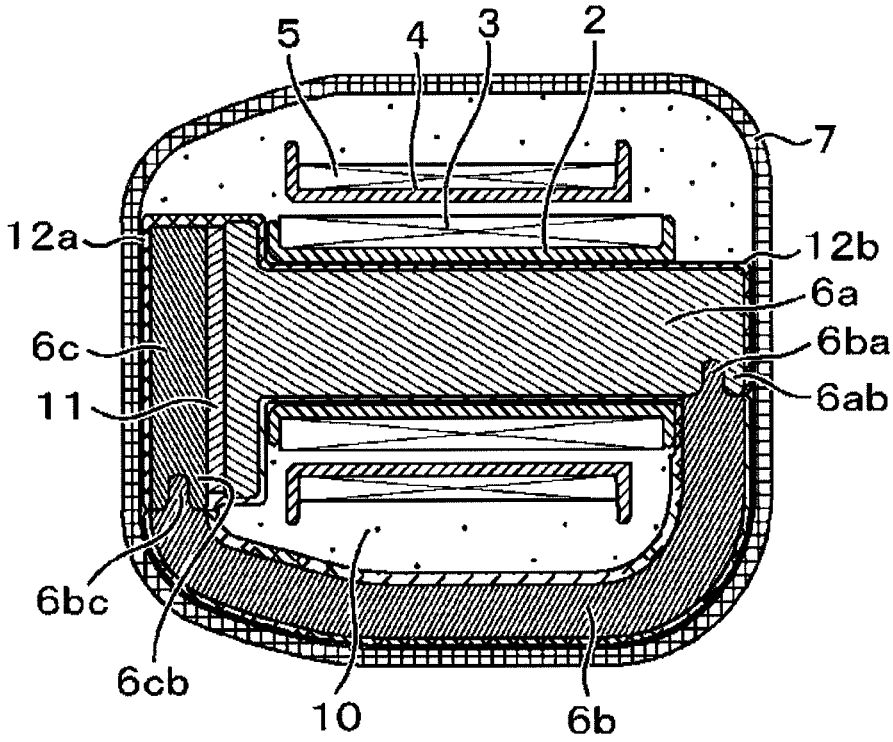
FIG. 7 is a cross-sectional view of an ignition coil according to a third embodiment.

As shown in FIG. 7, an ignition coil according to a third embodiment is configured to have only one side of the side core portion 6*b* in the first embodiment. In this case, a fitting-recessed portion 6*cb* is located on a lateral surface of an auxiliary core portion 6*c*. In addition, a fitting-projection 6*bc* is located at an end portion of the side core portion 6*b* corresponding to the fitting-recessed portion 6*cb*. A fitting-recessed portion 6*ab* is located on an end lateral surface, of the main core portion 6*a*, on the side opposite the auxiliary core portion side. In addition, a fitting-projection 6*ba* is located at an end portion of the side core portion 6*b* corresponding to the fitting-recessed portion 6*ab*. The fitting-recessed portion 6*cb* is fitted to the fitting projection 6*bc*. The fitting-recessed portion 6*ab* is fitted to the fitting projection 6*ba*. Thus, an iron core assembly can be formed.

Fourth Embodiment

Figure 8:
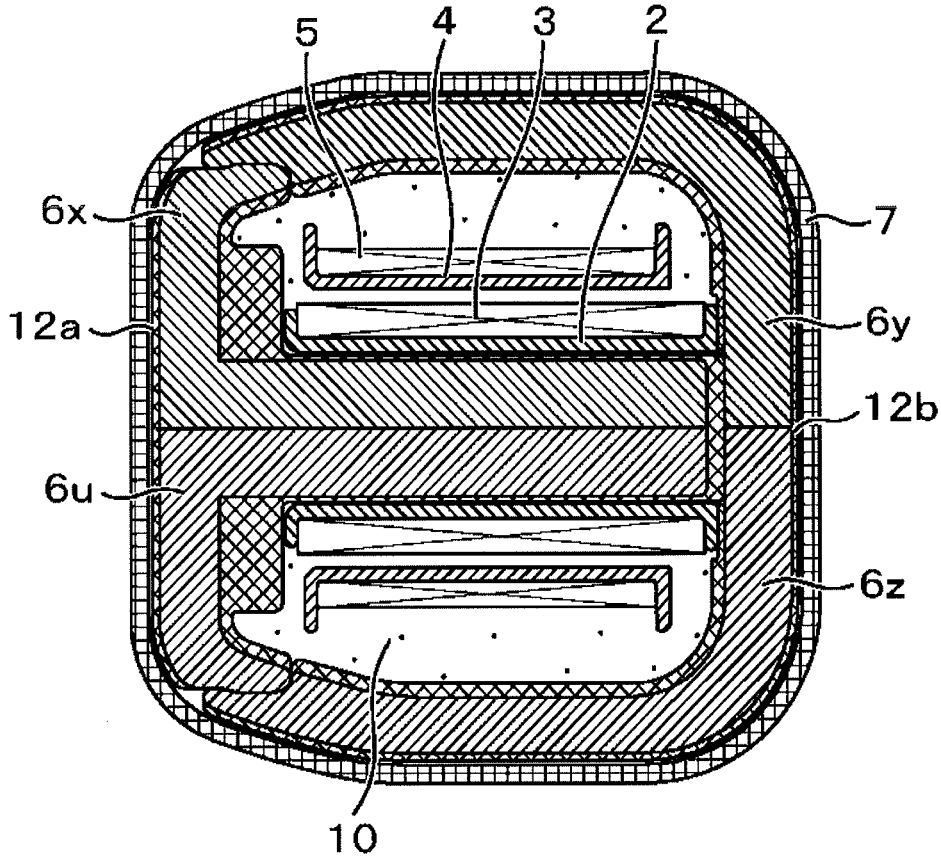
FIG. 8 is a cross-sectional view of an ignition coil according to a fourth embodiment.

A fourth embodiment is described with reference to FIG. 8. Referring to FIG. 8, the auxiliary core portion 6*c* and the main core portion 6*a* in the second embodiment are each divided into two parts 6*x* and 6*u* with respect to the longitudinal centerline of the main core portion 6*a*. In addition, the side core portion 6*b* in FIG. 8 is divided into two parts 6*y* and 6*z*. If the iron portions are divided as described above, stock layout encountered when iron cores are punched out from a silicon steel plate can be improved. If the number of division is increased, assembly performance is degraded. However, the iron cores which are divided so as to bring an iron core assembly 6 into the two parts are united by core molds; therefore, an ignition coil can be reduced in cost without degrading assembly performance.

Fifth Embodiment

Figure 9:
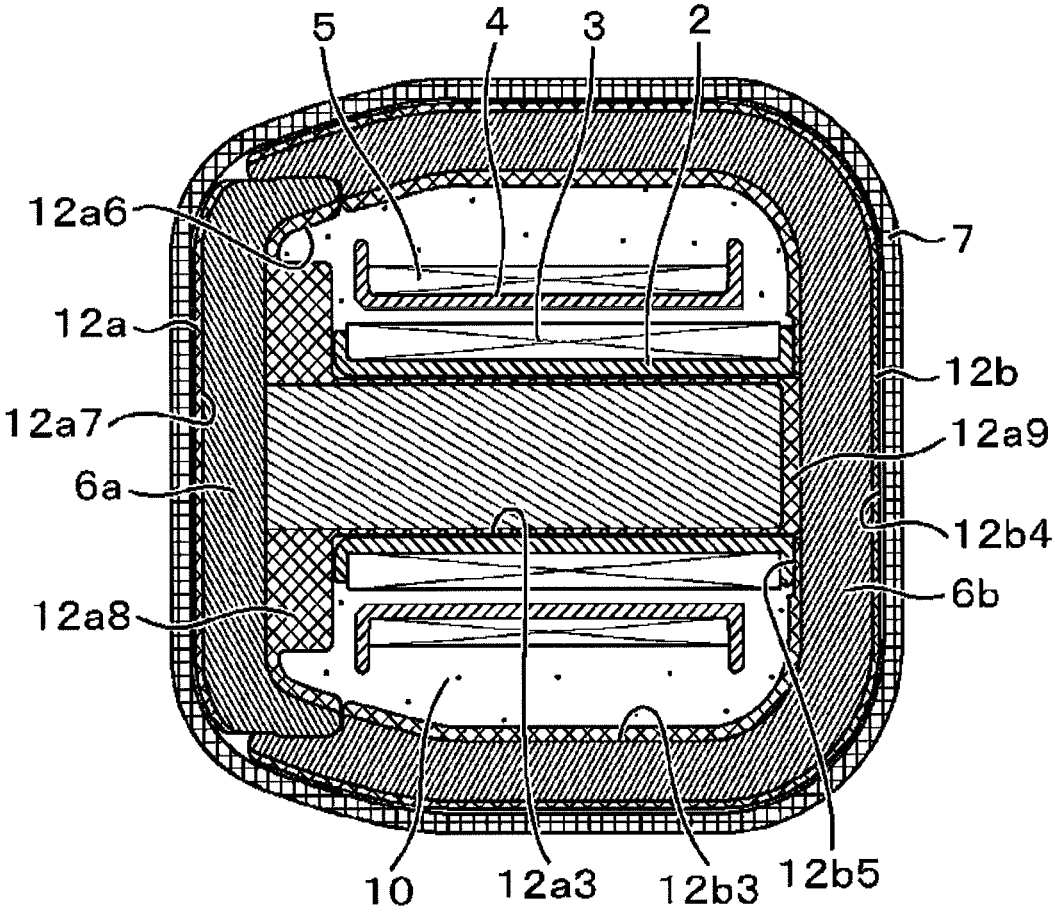
FIG. 9 is a cross-sectional view of an ignition coil according to a fifth embodiment.

Referring to FIG. 9, in a fifth embodiment, an auxiliary core portion 6*c* and a main core portion 6*a* are punched out as steel plates divided similarly to the first embodiment. The steel plates of the auxiliary core portion 6*c* and those of the main core portions 6*a* are separately stacked and united together. Thereafter, both are covered by a core mold 12 without a magnet member.

In the embodiments described above, the material of the iron core assembly 6 is the stacked silicon steel plates. However, also iron cores formed by compressing iron-based powder and covered by a resinous cover, an elastomer film or a rubber film can produce the same function and effect as above.

What is claimed is:

1. An ignition coil comprising:

a coil being attached to a main core portion, and being sandwiched between and held by an auxiliary core portion and a side core portion; and a covering layer made of an elastic body, the covering layer being formed in a clearance at least between an end face of a coil bobbin and an inner circumferential surface of the main core portion or the auxiliary core portion facing the end face of the coil bobbin;

wherein flange portions of the main core portion and the auxiliary core portion are covered with the covering layer made of the elastic body and configured as a single molded assembly component;

wherein the covering layer has a portion projecting in a stacking direction of the main core portion that positions the coil bobbin into which the main core portion is inserted;

a projecting portion of the coil bobbin is formed at the auxiliary core portion side of the coil bobbin;

a recess is formed by the portion of the covering layer projecting in the stacking direction and a remainder of the covering layer; and the projecting portion of the coil bobbin fits in the recess so that the coil bobbin is positioned.

2. The ignition coil according to claim 1, wherein the covering layer is formed over the full circumferences of the main core portion and the auxiliary core portion except a fitting-engaging portion of the auxiliary core portion with the side core portion.

3. The ignition coil according to claim 1, wherein the covering layer is also formed on an inner circumferential surface, of the side core portion, facing the coil bobbin.

4. The ignition coil according to claim 1, wherein inner and outer full circumferences of an iron core assembly are covered by the covering layer except an fitting-engaging portion of the auxiliary core portion with the side core portion and a contact surface portion between the main core portion and the side core portion.

5. The ignition coil according to claim 1, wherein a magnet member is sandwiched between the auxiliary core portion and the main core portion.

6. The ignition coil according to claim 5, wherein the magnet member is a magnetized magnet member.

7. The ignition coil according to claim 5, wherein the magnet member is a non-magnetized magnet member.

8. The ignition coil according to claim 1, wherein the auxiliary core portion and the main core portion are formed as a continuous integral one by punching out a steel plate and stacking the steel plates.

9. The ignition coil according to claim 1, wherein a fitting-engaging portion of the auxiliary core portion with the side core portion is formed between an end portion outer circumferential surface of the auxiliary core portion and an end portion inner circumferential surface of the side core portion or between an end portion inner circumferential surface of the auxiliary core portion and an end portion outer circumferential surface of the side core portion.

10. The ignition coil according to claim 1, wherein the projecting portion extends on one of the end surfaces facing each other in the stacking direction of the main core portion.

11. An ignition coil comprising:

a coil;

a main core portion to which the coil is attached;

a side core portion surrounding the circumference of the coil;

an auxiliary core portion connecting the main core portion with the side core portion; and a permanent magnet disposed between the auxiliary core portion and the main core portion;

wherein the main core portion, the side core portion and the auxiliary core portion forming a closed magnetic path, the permanent magnet generating magnetic flux in a direction opposite to magnetic flux passing through the closed magnetic path, a resin film or an elastic film covers the circumference of the side core portion except a joint surface of the side core portion to the auxiliary core portion and a joint surface of the side core portion to the main core portion, and in a state where the auxiliary core portion and the main core portion are combined with each other with the permanent magnet sandwiched therebetween, a resin film or an elastic film covers respective circumferences of the auxiliary core portion, the permanent magnet, and the main core portion except a joint surface of the auxiliary core portion to the side core portion and a joint surface of the main core portion to the side core portion;

wherein flange portions of the main core portion and the auxiliary core portion are covered with a covering layer made of an elastic body and configured as a single molded assembly component;

wherein the covering layer has a portion projecting in a stacking direction of the main core portion that positions a coil bobbin into which the main core portion is inserted;

a projecting portion of the coil bobbin is formed at the auxiliary core portion side of the coil bobbin;

a recess is formed by the portion of the covering layer projecting in the stacking direction and a remainder of the covering layer; and the projecting portion of the coil bobbin fits in the recess so that the coil bobbin is positioned.

12. The ignition coil according to claim 11, wherein the resin film or elastic film covering the core portions has a thickness greater in an iron core stacking direction than in a direction perpendicular to the iron core stacking direction.

13. The ignition coil according to claim 11, wherein the resin film or the elastic film covering both surfaces, in the iron core stacking direction, of the core portions is partially formed with a recessed portion reaching surfaces of the core portions or the permanent magnet.

14. The ignition coil according to claim 11, wherein a primary coil portion is attached to an outer circumference of the resin film or the elastic film at a portion corresponding to the main core portion of an assembly of the main core portion and the auxiliary core portion, a secondary coil portion is attached to an outer circumference of the primary coil portion, the assembly of the main core portion and the auxiliary core portion, the primary coil portion, the secondary coil portion and the side core portion are housed in a coil case, and an insulating resin is filled in the coil case and the coil case is sealed.

15. The ignition coil according to claim 11, wherein a division surface of the core portion is formed as a surface perpendicular to an iron core stacking direction.

16. The ignition coil according to claim 11, wherein the resin film or the elastic film covering the outer circumference of the core portion is provided with convexity and concavity on one side or both sides, in an iron core stacking direction, of the auxiliary core portion and of the side core portion, and when a bobbin around which the coil is wound is attached to the outer circumference of the main core portion, the bobbin is positioned.

17. The ignition coil according to claim 11, wherein an engaging portion is formed between a side surface of the auxiliary core portion and one end portion of the side core portion and between an end portion side surface, of the main core portion, on a side opposite to the auxiliary core portion and the other end portion of the side core portion.

18. The ignition coil according to claim 11, wherein the main core portion is divided into parts in a longitudinal direction, and in a state where the divided parts of the main core portion are joined together, the resin film or the elastic film covers the circumference of the main core portion except a joint surface of the main core portion to the side core portion.

19. The ignition coil according to claim 11, wherein the side core portion is divided into parts symmetrically with respect to a longitudinal axis of the main core portion, and in a state where the divided parts of the side core portion are joined together, the resin film or the elastic film covers the circumference of the side core portion except a joint surface of the side core portion to the main core portion.

20. An ignition coil comprising:

a coil;

a main core portion to which the coil is attached;

a side core portion surrounding the circumference of the coil; and an auxiliary core portion connecting the main core portion with the side core portion;

wherein the main core portion, the side core portion and the auxiliary core portion forming a closed magnetic path, a resin film or an elastic film covers the circumference of the side core portion except a joint surface of the side core portion to the auxiliary core portion and a joint surface of the side core portion to the main core portion, and in a state where the auxiliary core portion and the main core portion are combined with each other, the resin film or the elastic film covers respective circumferences of the auxiliary core portion and the main core portion except a joint surface of the auxiliary core portion to the side core portion and a joint surface of main core portion to the side core portion;

wherein flange portions of the main core portion and the auxiliary core portion are covered with a covering layer made of an elastic body and configured as a single molded assembly component;

wherein the covering layer has a portion projecting in a stacking direction of the main core portion that positions a coil bobbin into which the main core portion is inserted; and a projecting portion of the coil bobbin is formed at the auxiliary core portion side of the coil bobbin;

a recess is formed by the portion of the covering layer projecting in the stacking direction and a remainder of the covering layer; and the projecting portion of the coil bobbin fits in the recess so that the coil bobbin is positioned.

21. The ignition coil according to claim 20, wherein the resin film or elastic film covering the core portions has a thickness greater in an iron core stacking direction than in a direction perpendicular to the iron core stacking direction.

* * * * *